US005298952A

United States Patent [19]

Kamijo et al.

[11] Patent Number: 5,298,952

[45] Date of Patent: Mar. 29, 1994

[54] TONER SUPPLYING DEVICE FOR IMAGE FORMING SYSTEM

[75] Inventors: Masahiko Kamijo, Kawasaki; Shigemi Kanda, Atsugi, both of Japan

[73] Assignee: Ricoh Company, Ltd., Tokyo, Japan

[21] Appl. No.: 912,770

[22] Filed: Jul. 13, 1992

[30] Foreign Application Priority Data

Jul. 15, 1991 [JP] Japan ..... 3-173798

[51] Int. Cl.[5] ..... G03G 15/06; G03G 21/00

[52] U.S. Cl. ..... 355/270; 355/200; 355/245; 355/260; 355/296; 355/298; 366/328

[58] Field of Search ..... 355/200, 202, 296, 298, 355/269, 270, 245, 260, 251, 253; 222/DIG. 1; 366/302, 324, 325, 328; 416/231 A

[56] References Cited

U.S. PATENT DOCUMENTS

| | | | |
|---|---|---|---|
| 3,747,899 | 7/1973 | Latinen | 366/324 X |
| 4,095,307 | 6/1978 | Brubaker | 366/312 X |
| 4,593,997 | 6/1986 | Fox et al. | 355/298 |
| 4,926,217 | 5/1990 | Bares | 355/253 |
| 4,931,838 | 6/1990 | Ban et al. | 355/260 |
| 4,947,211 | 8/1990 | Ono et al. | 355/265 |
| 4,967,691 | 11/1990 | Chikama et al. | 355/245 X |
| 5,005,517 | 4/1991 | Fukui et al. | 355/253 X |
| 5,017,966 | 5/1991 | Suga | 355/260 |
| 5,075,728 | 12/1991 | Kobayashi et al. | 355/260 |
| 5,101,228 | 3/1992 | Nishikawa et al. | 355/298 X |
| 5,121,168 | 6/1992 | Aoki et al. | 355/298 |
| 5,126,799 | 6/1992 | Matsuura et al. | 355/298 |
| 5,134,960 | 8/1992 | Shirai | 355/245 X |
| 5,139,176 | 8/1992 | Reindl et al. | 355/260 |

FOREIGN PATENT DOCUMENTS

| | | |
|---|---|---|
| 4038677 | 6/1991 | Fed. Rep. of Germany . |
| 3-139679 | 6/1991 | Japan . |

*Primary Examiner*—Matthew S. Smith

*Attorney, Agent, or Firm*—Oblon, Spivak, McClelland, Maier & Neustadt

[57] ABSTRACT

A toner supplying device for use in an image forming system includes a cleaner portion for removing a residual toner from a photosensitive medium of the image forming system so as to store the residual toner therein, and a toner supplying portion, integrally formed with the cleaner portion, having a compartment for storing toner and a mechanism for supplying the toner to a developing unit so that a toner image is formed on a copy sheet in accordance with an electrostatic latent image on the photosensitive medium. In this device, the toner supplying portion includes an agitator member for agitating the toner within the toner supplying portion so as to prevent the toner from sticking to an inside wall of the toner supplying portion.

8 Claims, 7 Drawing Sheets

TONER SUPPLYING DEVICE FOR IMAGE FORMING SYSTEM

BACKGROUND OF THE INVENTION

The present invention generally relates to an image forming system, and more particularly to a toner supplying device of an image forming system, which device includes a cleaner portion for removing a residual toner from a photosensitive medium and an integrally formed toner supplying portion for supplying toner to a developing unit so that a toner image is formed on a copy sheet.

In image forming systems such as facsimile machines, printers and copiers, a cleaner toner magazine (CTM) unit is used in order to remove a residual toner on a photosensitive medium and store the residual toner, and to supply new toner to a developing unit so that a toner image is formed on a copy sheet. FIG. 12 shows a CTM unit used in an image forming system. In FIG. 12, the CTM unit includes a cleaner part 3 for removing the residual toner from a photosensitive medium (not shown) and a toner supplying part 5 for supplying new toner to a developing unit (not shown); these two parts are built into the one-piece unit. The cleaner part 3 includes a cleaning blade 1 for removing the residual toner, and a compartment 2 for storing the residual toner which is received from the photosensitive medium due to the cleaning blade 1. The toner supplying part 5 includes a toner transport screw 4 for supplying new toner to the developing unit.

In an image forming system of a different type having no CTM unit, the photosensitive medium, the developing unit, a replenishment toner storage tank, and a used toner storage tank are permanently united into a one-piece unit. When the replenishment toner in the storage tank is used up, it is necessary to replace the photosensitive medium or the developing unit, which is still usable and has not reached the end of its operating life. The image forming system with the CTM unit as described above has an advantageous feature in that the CTM unit, singly, can be replaced with a new CTM unit when the toner is used up, thus allowing the running cost per copy to be lowered.

However, when the CTM unit is replaced, for the replenishment of toner, there is a problem in that the replenishment toner partially sticks to an inside wall of the toner supplying part 5. The sticking of the toner may occur due to the changes of the chemical characteristics of the toner (e.g., the flowability or the adsorption characteristics) under certain environmental conditions or due to the physical arrangement of the CTM unit within the image forming system. For this reason, the amount of usable toner in the CTM unit is unsuitably reduced. Thus, it is desirable to make effective use of the replenishment toner in the CTM unit.

SUMMARY OF THE INVENTION

Accordingly, it is a general object of the present invention to provide an improved toner supplying device of an image forming system in which the above described problems are eliminated.

Another, more specific object of the present invention is to provide a toner supplying device which agitates the toner within the CTM unit to prevent the toner from sticking to the inside wall of the toner supplying part, thus making effective use of the toner in the CTM unit. The above mentioned object of the present invention is achieved by a toner supplying device of an image forming system, which device includes a cleaner portion for removing a residual toner from a photosensitive medium of the image forming system so as to store the residual toner therein, and a toner supplying portion, integrally formed with the cleaner portion, having a compartment for storing toner and a mechanism for supplying the toner to a developing unit so that a toner image is formed on a copy sheet in accordance with an electrostatic latent image on the photosensitive medium, wherein the toner supplying portion includes an agitator member for agitating the toner within the toner supplying portion so as to prevent the toner from sticking to an inside wall of the toner supplying portion. According to the present invention, it is possible to smoothly and safely supply the toner to the developing unit there remaining no residual toner in the CTM unit. Also, it is possible to positively prevent the toner from sticking to the inside wall of the toner supplying part. The agitator member has a simple construction; it is driven in an interlocking manner by a motor for driving the toner supplying mechanism. Also, it is possible to smoothly agitate the toner by means of the agitator member, and to reduce the rotating load on the agitator member so that the toner can be effectively agitated so as to reduce the amount of toner residual in the toner supplying device.

Other objects and further features of the present invention will become apparent from the following detailed description when read in conjunction with the accompanying drawings.

DESCRIPTION OF THE PREFERRED EMBODIMENTS

Figure 1:
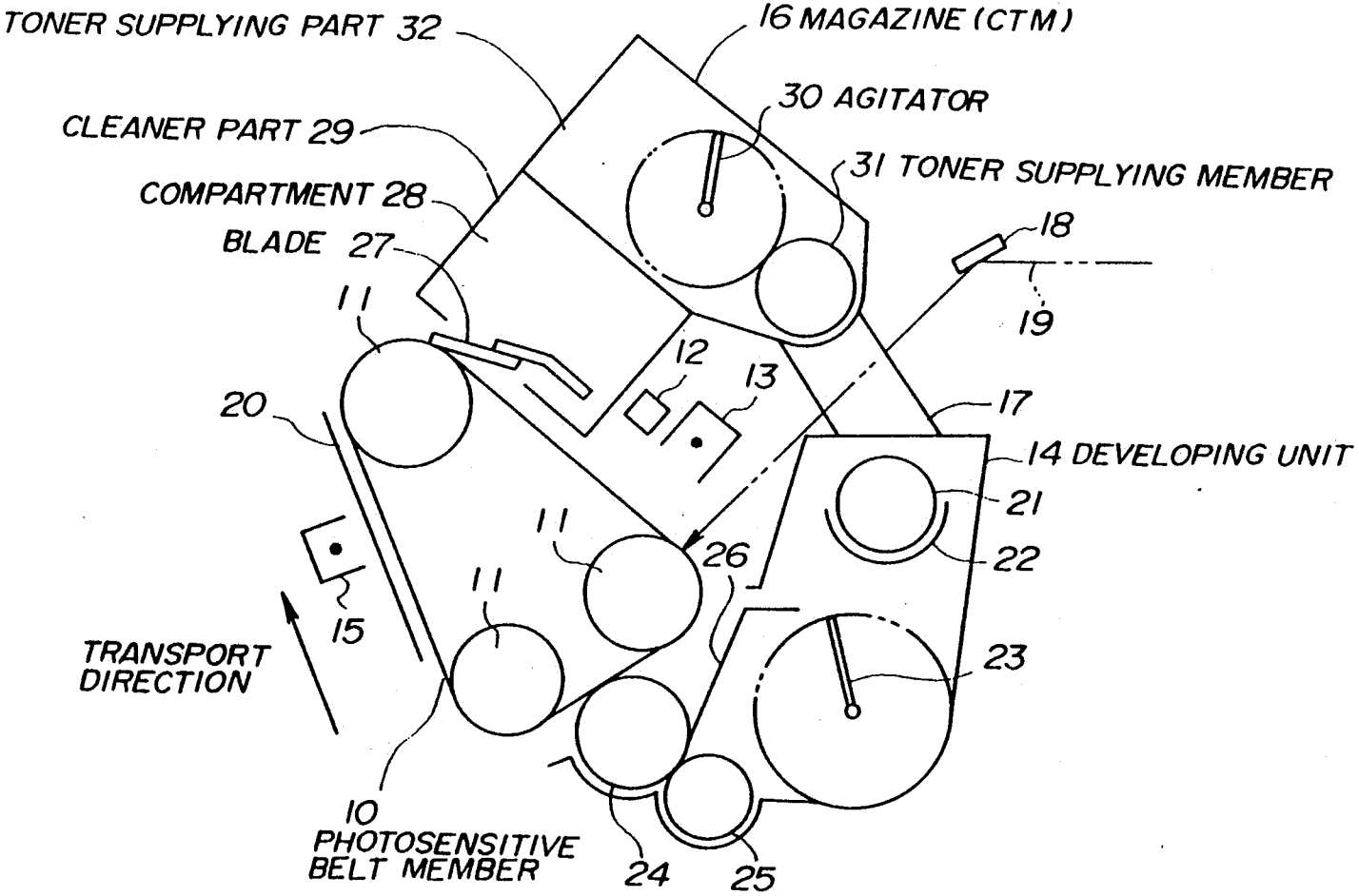
FIG. 1 is a view showing an image forming system to which an embodiment of a toner supplying device according to the present invention is applied.

A description will now be given, with reference to FIG. 1, of a first embodiment of a toner supplying device according to the present invention. FIG. 1 shows an image forming system in which the toner supplying device of the present invention is provided. In FIG. 1, a photosensitive belt member 10 is rotatably supported by three rollers 11, and this photosensitive belt member 10 is rotated around a circumference thereof due to rotation of the rollers 11. Similarly to an image forming system which is known in the art, a static eliminator 12, a charging unit 13, a developing unit 14, a transfer unit 15, and a magazine 16 are provided at the surrounding portions of the photosensitive belt member 10 within the image forming system.

In FIG. 1, a duct 17 is provided between the magazine 16 and the developing unit 14, in order to supply toner from the magazine 6 to the developing unit 14 via the duct 17. A copy sheet 20 supplied from a paper cassette (not shown) and brought in contact with the photosensitive belt member 10 is transported from the transfer unit 15 to the developing unit 14 via the magazine 16 when the photosensitive belt member 10 is rotated by the rollers 11. A light beam 19 emitted by a light source (not shown) is deflected by a deflection mirror 18, and the photosensitive belt member 10 is subjected to exposure to the deflected light beam 18 from the deflection mirror 18 so that an image is formed at an image forming position of the photosensitive belt member 10.

The developing unit 14 includes a first agitator 21, a U-shaped guide 22, and a second agitator 23. The first agitator 21 supported by the U-shaped guide 22 serves to agitate toner which is fed from the duct 17 into the developing unit 14. The developing unit 14 also includes a developing roller 24 placed in contact with the photosensitive belt member 10, a supplementary roller 25 placed in contact with the developing roller 24, and a blade 26. The second agitator 23 serves to feed toner from the developing unit 14 to the rollers 24 and 25. The blade 26 is arranged so as to be in contact with the developing roller 24; this blade 26 serving to maintain a thickness of a layer of toner formed on the developing roller 24 at a prescribed level.

The magazine 16 includes a cleaner part 29 and a toner supplying part 32; these two parts are built into a cleaner toner magazine (CTM) unit. The cleaner part 29 includes a cleaning blade 27 arranged in contact with the photosensitive belt member 10 so as to eliminate the residual toner on the photosensitive belt member 10, and a compartment 28 to which the residual toner is conveyed via the cleaning blade 27. Thus, the residual toner is stored in the compartment 28 of the cleaner part 29. New replenishment toner is accommodated or stored in the toner supplying part 32 of the magazine 16. This toner supplying part 32 includes an agitator member 30 and a toner supplying member 31, both of which will be described below in more detail.

Figure 2:
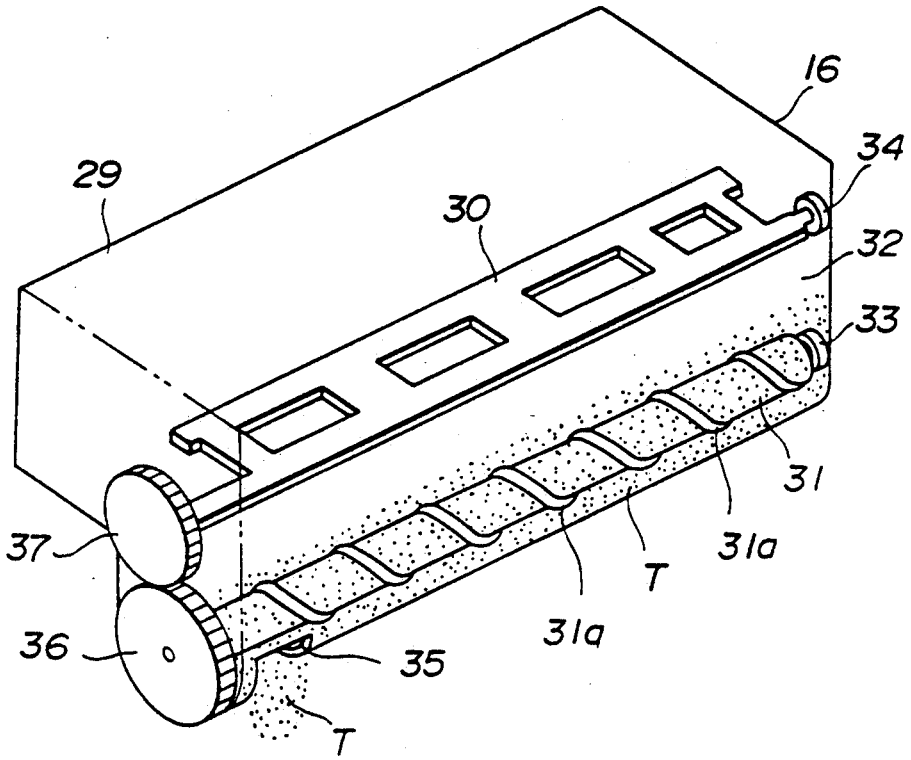
FIG. 2 is a perspective view showing the construction of the toner supplying device according to the present invention.

FIG. 2 shows the construction of the toner supplying device according to the present invention. In the toner supplying device, the agitator member 30 is a ladder-like sheet agitator in which a plurality of rectangular openings are formed. The toner supplying member 31 is a toner supplying screw. This toner supplying screw 31 is rotatably supported by means of bearings 33 at end portions of the toner supplying screw 31; a screw gear 36 is secured to a rotating shaft of the toner supplying screw 31. The sheet agitator 30, which extends parallel to the rotating shaft of the toner supplying screw 31, is rotatably supported by means of bearings 34; an agitator gear 37 is secured to a rotating shaft of the sheet agitator 30. In the toner supplying part 32 of the magazine 16, a toner outlet opening 35 is formed at an end portion of the toner supplying part 32 near the screw gear 36 secured to the toner supplying screw 31; this opening 35 communicates with the duct 17 for supplying toner into the developing unit 14.

Next, a description will be given of operations performed by the toner supplying device of the magazine 16 according to the present invention. In FIG. 2, the screw gear 36 and the agitator gear 37 are engaged with each other. A rotating force or torque is applied to the toner supplying screw via the screw gear 36 by an external drive motor (not shown in FIG. 2) so that the sheet agitator 30 and the toner supplying screw 31 are rotated together so as to supply toner from the magazine 16 to the developing unit 14.

Figure 3:
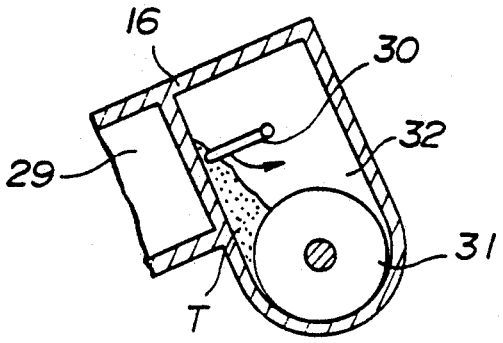
FIG. 3 is a sectional view of the toner supplying device for explaining operations performed by an agitator member of the toner supplying device.

More specifically, when the toner supplying screw 31 is rotated via the screw gear 36 by the external drive motor, the toner supplying screw 31 is rotated around the rotating shaft thereof, and a projecting portion 31*a* of the toner supplying screw 31 serves to transport toner T (existing in the surrounding portions of the toner supplying screw 31 within the toner supplying member 32) to the toner outlet opening 35. When the toner supplying screw 31 is rotated, the sheet agitator 30 is also rotated due to the engagement between the screw gear 36 and the sheet agitator 37, so that a scraper portion of the sheet agitator 30 is rotated around the rotating shaft thereof. This scraper portion of the sheet agitator 30 serves to agitate toner within the toner supplying member 32. If some toner sticks to the inside wall of the toner supplying member 32, it is possible, with this arrangement, to scrape the toner on the inside wall of the toner supplying member 32, so that the toner is transported to the toner supplying screw 31 and no residual toner remains therein. FIG. 3 shows such operations performed by the toner supplying member 32 according to the present invention. As shown in FIG. 2, if toner sticks to the inside wall of the toner supplying part 32, the toner can be scraped by the scraper portion of the sheet agitator 30 being rotated, and the toner is thus sent to the toner outlet opening 35 by means of the toner supplying screw 31.

Figure 4:
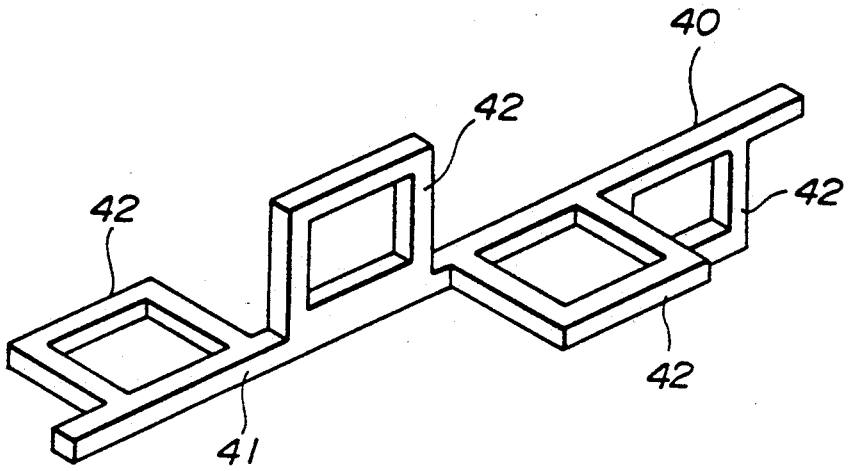
FIG. 4 is a perspective view showing another agitator member of the toner supplying device.

FIG. 4 shows a modification of the agitator member of the toner supplying part according to the present invention. In FIG. 4, the agitator member 40 includes a rotating shaft 41 and a plurality of frame portions 42 attached to the rotating shaft 41. Each of the frame portions 42 has a rectangular opening. For example, four frame portions 42 are attached to the rotating shaft 41, and an offset angle between each of the frame portions 42 with respect to each other is 90 degrees in a manner such that adjacent frame portions 42 are at right angles to each other within a plane perpendicular to the rotating shaft 41. When this agitator member 40 is used instead of the sheet agitator 30 of FIG. 2, the agitator member 40 is rotatably supported by the bearings 34, and the agitator gear 37 is secured to the rotating shaft of the sheet agitator 30. According to the agitator member of FIG. 4, it is possible to reduce the load when the toner within the toner supplying part is agitated by the agitator member. Also, it is possible to use a low-output drive motor for driving the rotating shaft of the toner supplying screw 31; such a drive motor is less expensive.

Figure 5:
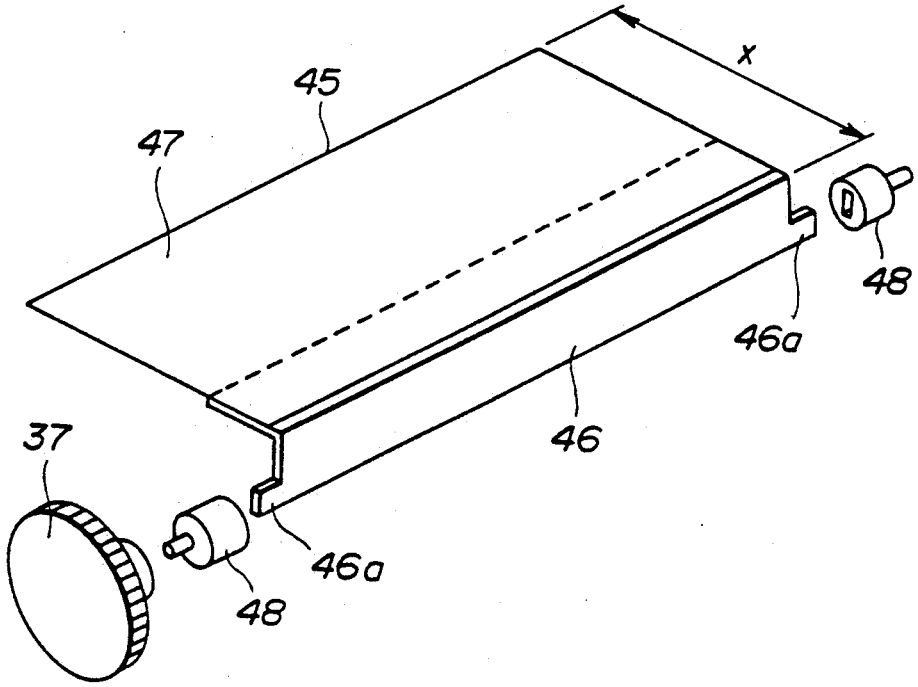
FIG. 5 is a perspective view showing still another agitator member of the toner supplying device.

FIG. 5 shows another modification of the agitator member of the toner supplying device according to the present invention. In FIG. 5, the agitator member 45 includes a supporting part 46 having an L-shaped cross-section, and a thin, flexible sheet part 47 attached at a side edge portion thereof to the supporting part 46. The supporting part 46 includes a pair of connecting edges 46*a* at its two end portions, respectively. A pair of rotary shaft parts 48 are secured to the connecting edges 46*a* of the supporting part 46 so as to form a rotating shaft of the agitator member 45. When the agitator member 45 is used instead of the sheet agitator 30 of FIG. 2, the agitator member 45 is rotatably supported by the bearings 34 at the rotary shaft parts 48, and the agitator gear 37 is secured to the rotating shaft of the agitator member 45 at one end portion thereof. The flexible sheet part 47 has a radial length "X" that is large enough for the other side edge portion of the flexible sheet part 47 to be in contact with the inside wall of the toner supplying part 32.

Figure 6B:
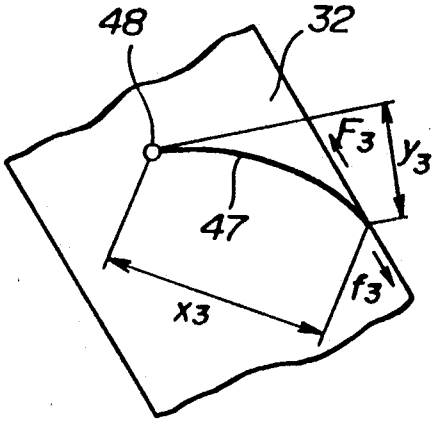
FIGS. 6A and 6B are diagrams for explaining operations performed by a flexible sheet part of the agitator member of FIG. 5.
Figure 6A:
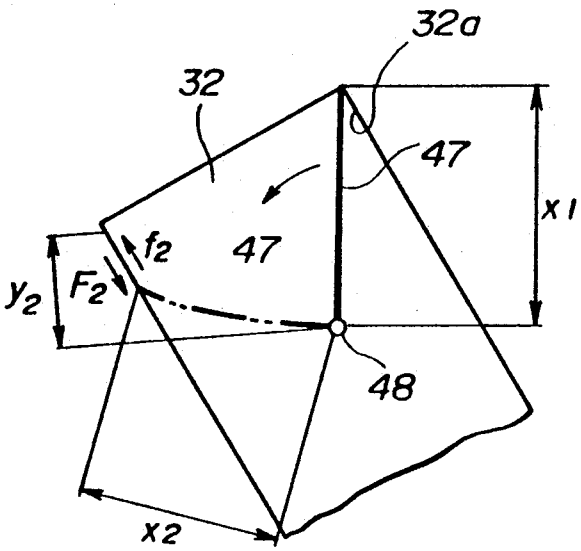

FIGS. 6A and 6B show operations performed by the flexible sheet part 47 of FIG. 5. As shown in FIG. 6A, the radial length "X" of the flexible sheet part 47 described above can be determined as being a distance "X1" between the center of the rotating shaft 48 and the farthest inside wall 32*a* of the toner supplying part 32. The thus determined radial length "X" allows the flexible sheet part 47 to come into contact with the inside wall of the toner supplying part 32 and to be resiliently deflected into a deflected condition when the agitator member 45 is rotated around the rotating shaft 48. When the radial length "X" of the flexible sheet part 47 in the deflected condition is equal to either "X2" or "X3" as shown in FIGS. 6A and 6B ($X2, X3 < X1$), a corresponding toner scraping force F2 or F3 needed to scrape the residual toner from the inside wall of the toner supplying part 32 varies in proportion to the deflection "Y2" or "Y3" of the flexible sheet part 47. Generally, the toner scraping force required to scrape the toner off the inside wall of the toner supplying part 32 varies depending on the deflection of the flexible sheet part 47 and depending on the modulus of elasticity of the flexible sheet part 47.

When the agitator member 45 in contact with the inside wall of the toner supplying device 32 is rotated around the rotating shaft 48, a friction force f2 or f3 acts on the flexible sheet part 47 at a corresponding contact point with the inside wall of the toner supplying part 32. This friction force produces a rotation load to the agitator member. If the rotating load is too high relative to the output power of the drive motor for rotating the toner supplying screw 31, the agitator member 45 may experience a trouble or malfunction in which the flexible sheet part 47 stops rotating around the rotating shaft 48.

Figure 7:
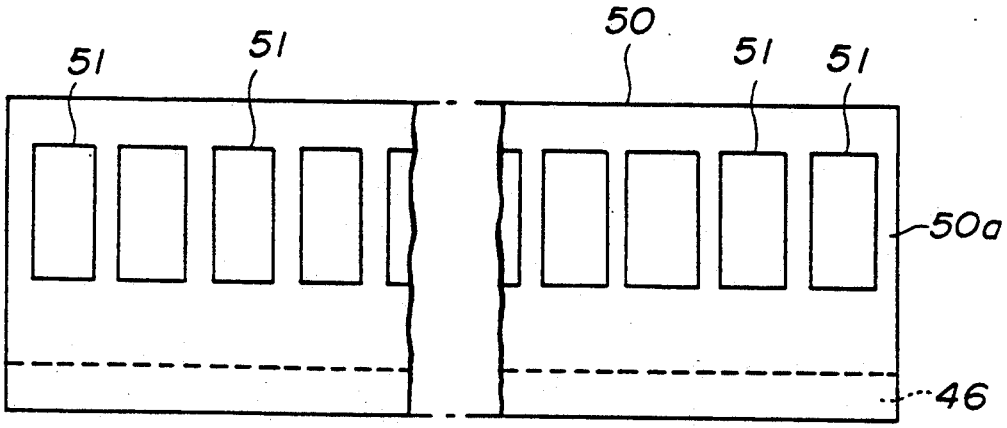
FIG. 7 is a view showing another flexible sheet part of the agitator member of FIG. 5.

In order to eliminate the above mentioned problem, the present invention proposes an improved flexible sheet part of the agitator member. FIG. 7 shows such a flexible sheet part 50 in which a plurality of rectangular openings 51 are formed in an extending portion 50*a* of the flexible sheet part 50 extending from the supporting part 46. By making use of this flexible sheet part 50, it is possible to reduce the friction forces f2 and f3 mentioned above. However, there is a tradeoff between the reduction of the friction forces and the increase of the toner scraping forces. It is thus desirable to predetermine the friction forces f2 and f3 in accordance with the specifications of the toner supplying device.

Figure 8:
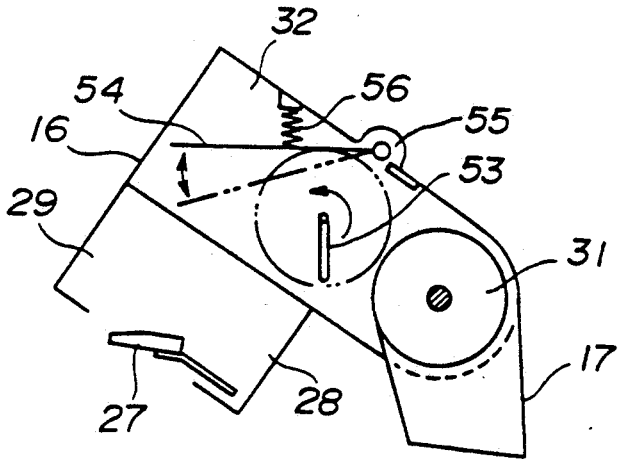
FIG. 8 is a diagram showing another embodiment of the toner supplying device according to the present invention.

Next, a description will be given of a second embodiment of the present invention. FIG. 8 shows a second embodiment of the toner supplying device according to the present invention. In FIG. 8, those parts which are the same as corresponding parts shown in FIGS. 2 and 3 are designated by the same reference numerals as in the previous drawings, and a description thereof will be omitted. In this toner supplying device, an oscillating plate 54 is provided, the oscillating plate 54 being made to oscillate by a ladder-like sheet agitator or frame-like agitator member 53 when the agitator member 53 is rotated around the rotating shaft. This agitator member 53 is rotatably supported by the bearings 34 at end portions thereof, and the screw gear 36 is secured to the rotating shaft of the toner supplying screw 31 as in FIGS. 2 and 3.

Figure 9:
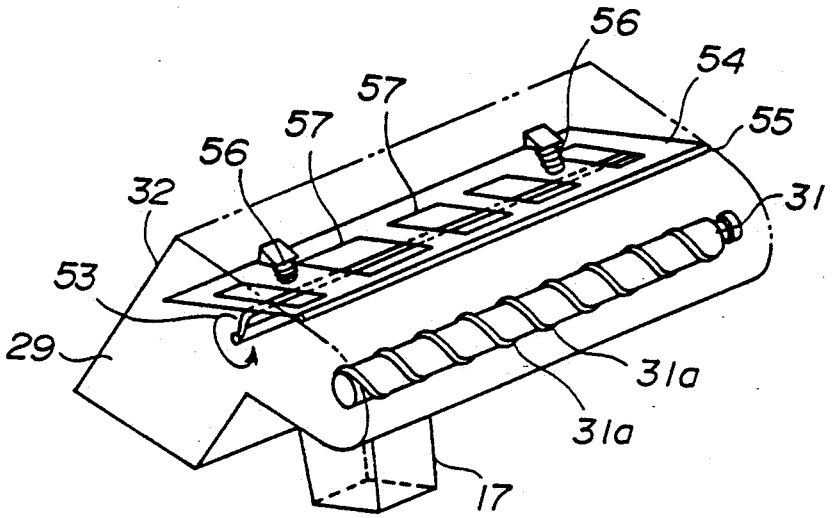
FIG. 9 is a perspective view showing an agitator member and an oscillating plate provided in the agitator member of FIG. 8.

The oscillating plate 54, which is provided within a rotation range in which the agitator member 53 is rotated, is rotatably supported at its side edge portions by a shaft 55 attached to the inside wall of the toner supplying part 32. The opposite side edge portion of the oscillating plate 54 lies so as to extend to a corner portion of the toner supplying part 32. By means of spring members 56, the oscillating plate 54 is biased onto the agitator member 53. The spring members 56 are placed on their ends onto the top surface of the oscillating plate 54, and secured at the other ends thereof to upper wall portions of the toner supplying part 32, respectively. As shown in FIG. 9, the oscillating plate 54 is formed so as to have a plurality of rectangular openings 57.

In the above mentioned second embodiment, the toner stored in the toner supplying part 32 is agitated by the agitator member 53. The oscillating plate 54, which moves up and down due to the rotation of the agitator member 53 as indicated by a dotted line in FIG. 8, serves to scrape from the inside wall of the toner supplying part 32 the toner sticking thereto. The edge portion of the oscillating plate 54 lies so as to extend to a corner portion of the toner supplying part 32. It is possible, with this arrangement, to effectively reduce the amount of the residual toner in the toner supplying part 32.

Figure 10:
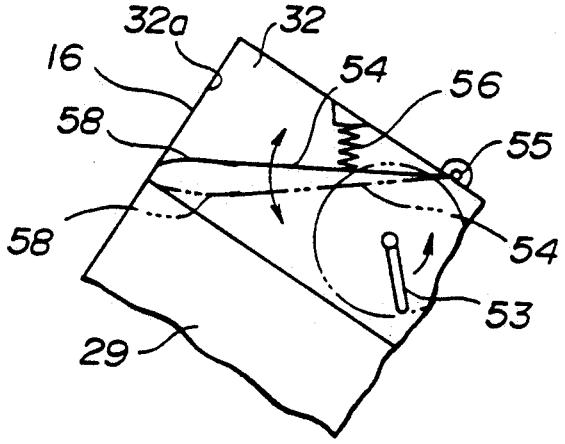
FIG. 10 is a diagram showing a flexible part attached to a leading edge portion of the oscillating plate of FIG. 9.

FIG. 10 shows a flexible plate member attached to a leading edge portion of the oscillating plate of FIG. 9. In FIG. 10, this flexible plate member 58 is attached to a leading edge portion of the oscillating plate 54 shown in FIGS. 8 and 9, in a manner such that an end portion of the flexible plate member 58 lies so as to extend to the corner portion of the toner supplying part 32. The flexible plate member 58 moves up and down, as indicated by a dotted line in FIG. 10, when the agitator member 53 is rotated, and the leading edge of the flexible plate member 58 flexibly comes into contact with the inside wall of the toner supplying part 32. Thus, it is possible to more efficiently reduce the amount of the sticking toner in the toner supplying part 32.

Figure 11:
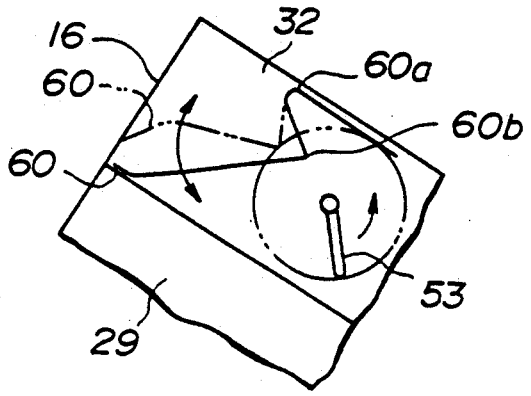
FIG. 11 is a sectional view showing still another embodiment of the toner supplying device in which a flexible plate member is provided.
Figure 12:
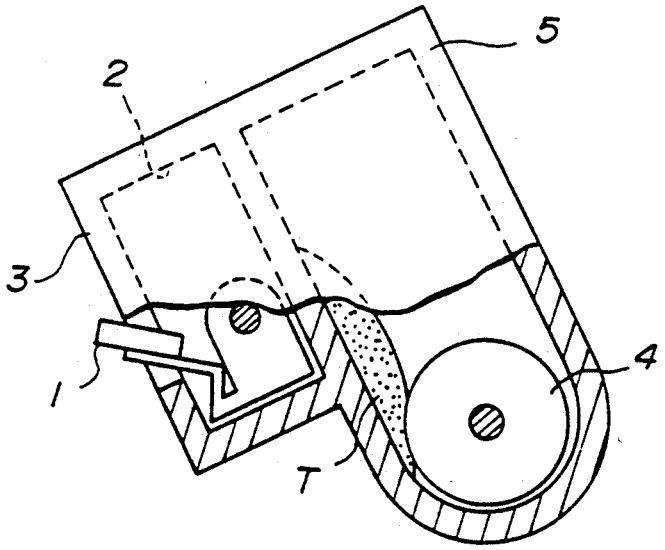
FIG. 12 (PRIOR ART)
FIG. 12 is a sectional view showing a toner supplying device provided in an image forming system.

FIG. 11 shows a third embodiment of the toner supplying device in which a flexible plate member is provided. In FIG. 11, the flexible plate member 58 and the oscillating plate 54 shown in FIG. 10 are formed into a generally S-shaped, flexible plate member 60. This flexible plate member 60 includes a first bent portion 60*a* and a second bent portion 60*b*. The second bent portion 60*b* is placed within the rotation range in which the agitator member 53 is rotated, and the flexible plate member 60 is rotated around the first bent portion 60*a* when the agitator member 53 is rotated. The leading edge of the flexible plate member 60 flexibly comes in contact with the corner portion of the toner supplying part 32. Due to the rotation of the agitator member 53, the flexible plate member 60 is reciprocatingly placed in the original condition indicated by a solid line in FIG. 11 or in a deflected condition indicated by a dotted line. Thus, it is possible to agitate the toner in the toner supplying part 32 and scrape the sticking toner from the inside wall of the toner supplying part 32. In the above mentioned embodiment, the flexible plate member 60 of FIG. 11 concurrently serves as the oscillating plate 54, the shaft 55, the springs 56 and the flexible plate member 58 shown in FIG. 10, which allows simplification of the construction of the toner supplying device for positively preventing the sticking of toner to the inside wall of the toner supplying part.

Further, the present invention is not limited to the above described embodiments, and variations and modifications may be made without departing from the scope of the present invention.

What is claimed is:

1. A toner supplying device for use in an image forming system, said device comprising:

cleaner means for removing toner from a photosensitive medium of the image forming system so as to store the toner of the photosensitive medium in said cleaner means; and toner supplying means, integrally formed with said cleaner means, having a compartment for storing toner and a mechanism for supplying the toner of the compartment to a developing unit so that a toner image is formed on a copy sheet in accordance with an electromagnetic latent image on the photosensitive medium;

said toner supplying means including agitator means for agitating the toner within the toner supplying means so as to prevent said toner from sticking to an inside wall of the toner supplying means, said agitator means being rotatable around a longitudinal axis of said agitator means, and said toner supplying means further including an oscillating member with a leading edge portion which comes into contact with an inside portion of said compartment of said toner supplying means when said agitator means is rotated, said oscillating member being arranged so as to transversely extend within said compartment of said toner supplying means, and said oscillating member being oscillated by said agitator means.

2. A device according to claim 1, wherein said agitator means is rotated in an interlocking manner by a drive motor for driving said toner supplying mechanism to supply the toner of said compartment to the developing unit.

3. A device according to claim 1, wherein said agitator means is a ladder-like sheet agitator having a plurality of rectangular openings.

4. A device according to claim 1, wherein said agitator means is an agitator member having an longitudinally extending rotating shaft, a supporting part with an L-shaped cross-section, and a flexible sheet part attached to the supporting part, said flexible sheet part being rotatable around the rotating shaft.

5. A device according to claim 4, wherein said flexible sheet part of said agitator means has a radial length that allows a leading side edge portion of said flexible sheet part to contact an inside wall of the toner supplying means.

6. A device according to claim 4, wherein said flexible sheet part of said agitator means is formed with a plurality of openings.

7. A device according to claim 1, wherein said oscillating member is oscillated member is oscillated by said agitator means when said agitator means is rotated, so that an edge part of said oscillating member is slidable on an inside wall of said compartment of said toner supplying means.

8. A device according to claim 1, wherein said oscillating member includes a flexible sheet part attached to a leading edge of said oscillating member, said flexible sheet part having a leading edge which comes into contact with a corner part of said compartment of said toner supplying means.

* * * * *